US005178692A

United States Patent [19]

Panchanathan

[11] Patent Number: 5,178,692

[45] Date of Patent: Jan. 12, 1993

[54] ANISOTROPIC NEODYMIUM-IRON-BORON POWDER WITH HIGH COERCIVITY AND METHOD FOR FORMING SAME

[75] Inventor: Viswanathan Panchanathan, Anderson, Ind.

[73] Assignee: General Motors Corporation, Detroit, Mich.

[21] Appl. No.: 820,165

[22] Filed: Jan. 13, 1992

[51] Int. Cl.[5] ..... H01F 1/02

[52] U.S. Cl. ..... 148/101; 148/104; 148/105

[58] Field of Search ..... 148/101, 104, 105, 120, 148/121; 420/83, 121

[56] References Cited

U.S. PATENT DOCUMENTS

| | | | |
|---|---|---|---|
| 3,792,367 | 12/1988 | Lee | 148/104 |
| 4,802,931 | 2/1989 | Croat | 148/302 |
| 4,842,656 | 6/1989 | Maines et al. | 148/302 |
| 4,952,239 | 8/1990 | Tokunaga et al. | 148/302 |
| 4,983,232 | 1/1991 | Endoh et al. | 148/302 |
| 4,994,109 | 2/1991 | Willman et al. | 148/105 |
| 5,026,438 | 6/1991 | Young et al. | 148/101 |

*Primary Examiner*—John P. Sheehan

*Attorney, Agent, or Firm*—George A. Grove; Domenica N. S. Hartman

[57] ABSTRACT

The magnetic coercivity of magnetically anisotropic powder containing the magnetic phase $Nd_2Fe_{14}B$, which already has appreciable magnetic coercivity, is enhanced by the method of this invention. The powder is produced by melt spinning an appropriate composition to form amorphous or extremely finely crystalline particles, hot working the particles to produce grains containing the $Nd_2Fe_{14}B$ phase and having dimensions in the range of about 20 to about 500 nonometers, comminuting the worked body to a powder, and then appropriately heating the powder to a temperature of between about 550° C. to about 675° C. followed by a normal cooling in the protective atmosphere of the furnace. The heat-treated powder exhibits magnetic anisotropy and magnetic coercivity of at least about 5,000 Oersteds at room temperature.

4 Claims, No Drawings

ANISOTROPIC NEODYMIUM-IRON-BORON POWDER WITH HIGH COERCIVITY AND METHOD FOR FORMING SAME

The present invention generally relates to the making of a powdered composition based on iron, neodymium and/or praseodymium, and boron which is magnetically anisotropic and characterized by enhanced magnetic coercivity of at least about 5,000 Oersteds at room temperature. More specifically, this invention relates to the heat treating of a magnetically anisotropic powdered composition so as to further enhance the magnetic coercivity of the powder.

BACKGROUND OF THE INVENTION

Permanent magnets based on compositions containing iron, neodymium and/or praseodymium, and boron are now known and in commercial usage. Such permanent magnets contain as an essential magnetic phase grains of tetragonal crystals in which the proportions of iron, neodymium and boron (for example) are exemplified by the empirical formula $Nd_2Fe_{14}B$. These magnet compositions and methods for making them are described by Croat in U.S. Pat. No. 4,802,931 issued Feb. 7, 1989. The grains of the magnetic phase are surrounded by a second phase that is typically rare earth-rich, as an example neodymium-rich, as compared with the essential magnetic phase. It is known that magnets based on such compositions may be prepared by rapidly solidifying (such as by melt spinning) a melt of the composition to produce fine grained, magnetically isotropic platelets of ribbon-like fragments. Magnets may be formed from these isotropic particles by practices which are known and which will be discussed further herein. The isotropic particles have many useful applications, but as recognized by the art there is also a need for an anisotropic powder with a high coercivity at room temperature.

Lee, U.S. Pat. No. 4,782,367, issued Dec. 20, 1988, demonstrated that the melt-spun isotropic powder can be suitably hot pressed and/or hot worked and plastically deformed to form high strength anisotropic permanent magnets. Such magnets have excellent magnetic properties. Maines et al, U.S. Pat. No. 4,842,656, issued Jun. 27, 1989, demonstrated that an anisotropic powder having a magnetic coercivity of at least about 1,000 Oersteds could be formed from the magnetic bodies of Lee by pulverizing the hot-worked magnetic bodies to a powder. The resultant particles of the powder are both magnetically anisotropic and have retained appreciable magnetic coercivity.

Further work in this area has focused on improving the coercivity of the anisotropic powder so as to be capable of forming magnetic bodies having improved magnetic properties. U.S. Pat. No. 4,952,239 to Tokunaga et al, issued Aug. 28, 1990, improves the coercivity of the anisotropic particles by appropriately heat treating the hot-worked magnetic body prior to forming the particles by pulverization. U.S. Pat. No. 4,983,232 to Endoh et al, issued Jan. 8, 1991, attempts to improve the coercivity of the anisotropic particles by appropriate additions of gallium to the magnetic composition, as well as by heat treating the hot-worked magnetic body prior to pulverization for formation of the particles.

Although these prior art methods have worked satisfactorily to produce anisotropic particles having coercivities of at least about 1,000 Oersteds at room temperature, it would be desirable to even further enhance the coercivity of these anisotropic particles.

SUMMARY OF THE INVENTION

It is therefore an object of this invention to provide anisotropic particles of a composition that has as its magnetic constituent the tetragonal crystal phase $RE_2TM_{14}B$ primarily based on neodymium and/or praseodymium, iron and boron, wherein the particles have a coercivity value of at least about 5,000 Oersteds at room temperature.

It is a further object of this invention to provide a method for forming such magnetically anisotropic particles characterized by such a high coercivity.

In accordance with a preferred embodiment of this invention, these and other objects and advantages are accomplished as follows.

According to the present invention, there is provided magnetically anisotropic particles of a composition that has as its magnetic constituent the tetragonal crystal phase $RE_2TM_{14}B$, wherein the particles have an intrinsic coercivity at room temperature of at least 5,000 Oersteds.

Generally, the compositions of this invention comprise, on an atomic percentage basis, about 40 to 90 percent of iron or mixtures of cobalt and iron, about 10 to 40 percent of rare earth metal that necessarily includes neodymium and/or praseodymium, and at least 0.5 percent boron. Preferably, iron makes up at least about 40 atomic percent of the total composition, and neodymium and/or praseodymium make up at least about six atomic percent of the total composition. Preferably, the boron content is in the range of about 0.5 to about 10 atomic percent of the total composition, but the total boron content may suitably be higher that this depending on the intended application. It is further preferred that iron make up at least 60 atomic percent of the non-rare earth metal content and that the neodymium and/or praseodymium make up at least about 60 atomic percent of the rare earth content.

The magnetically anisotropic powder of this invention is preferably formed by starting with such a composition that has been suitably rapidly solidified to produce an amorphous material or a finely crystalline material in which the grain size is less than about 400 nanometers in largest dimension. It is most preferred that the rapidly solidified material be amorphous or, if extremely finely crystalline, have a grain size smaller than about 20 nanometers. Such material may be produced, for example, by melt spinning.

Such rapidly solidified material is hot pressed in a die at temperatures on the order of about 700° C. or higher and at a sufficient pressure and duration to form a fully dense material that has magnetic coercivity at room temperature in excess of about 1,000 Oersteds and preferably in excess of about 5,000 Oersteds. Usually when melt-spun material finer than about 20 nanometers in grain size is heated at about 750° C. for a period of a minute or so and hot pressed to full density, the resultant body is a permanent magnet. Further, the magnetic body is slightly magnetically anisotropic. If the particulate material has been held at the hot pressing temperature for a suitable period of time, it will then have a grain size in the range of about 20 to about 500 nanometers, preferably about 20 to 100 nanometers. If the hot pressed body is then hot worked, that is, plastically deformed at such an elevated temperature, to deform the grains without effecting an increase in grain size above 500 nanometers, the resultant product displays appreciable magnetic anisotropy. It is not uncommon for the hot-worked product to have an energy product of about 30 MegaGaussOersted or higher.

The hot pressed or hot worked bodies are then pulverized to a powder. The particles of the powder are both magnetically anisotropic (meaning that each particle has a preferred direction of magnetization) and have retained appreciable magnetic coercivity. The powder may have particles preferably in the size range of about 50 to about 500 microns, most preferably about 100 to 250 microns, with each particle containing many of the deformed and aligned grains and each grain being platelet shaped with a largest dimension no greater than about 500 nanometers. The grain contain aligned $Fe_{14}Nd_2B$ (or the equivalent) tetragonal crystals that provide magnetic properties to the material.

In accordance with the preferred teachings of this invention, the magnetic coercivity of these particles is further enhanced by heat treating the individual particles of the powder. Preferably, the particles are heated to a temperature of about 550° C. to about 675° C., most preferably about 600° C., and for a duration sufficient to uniformly heat the particles so as to increase the coercivity of the particles. The reason for this increase in coercivity is unclear but is possibly due to cumulative stress relief within the grains and a correspondingly increase in the grain boundary surface area. The rate of cooling is not overly critical as the particles may be cooled in the furnace to room temperature so long as the rate of cooling is at least about 1° C. per second, or by cooling more quickly using forced ventilation or by even quenching. It is preferred that cooling occur by ventilation of the argon, or other inert, atmosphere around the particles within the furnace. Because of the small size of the particles, they cool relatively quickly regardless of which manner of cooling is employed.

The coercivity of anisotropic particles heat treated in accordance with this invention was improved significantly. As an example, anisotropic particles heated to about 600° C. in argon for about four minutes exhibited an increase in coercivity from about 12.8 kiloOersteds (kOe) to about 13.9 kiloOersteds.

A particularly advantageous feature of this invention is that the magnetic coercivity of the anisotropic particles is enhanced by heat treating of the particles without a loss in the other magnetic properties of the particle, particularly the magnetic remanence. Therefore, a suitable quantity of these particles may be magnetically aligned and bonded together to form a magnetic body that has a preferred direction of magnetization which may be then be useful in a variety of applications which require a permanent magnet having strong anisotropic properties.

Other objects and advantages of this invention will be better appreciated from the following detailed description.

DETAILED DESCRIPTION OF THE INVENTION

Magnetically anisotropic particles of a composition that has as its magnetic constituent the tetragonal crystal phase $RE_2TM_{14}B$, principally $Nd_2Fe_{14}B$, wherein the particles are characterized by enhanced, high levels of intrinisic coercivity, were formed in accordance with the methods of this invention by appropriately heat treating anisotropic particles produced by pulverizing a hot-worked magnetic body.

The anisotropic particles employed in this invention were formed in accordance with the teachings of U.S. Pat. No. 4,842,656 to Maines et al, which is incorporated herein by reference. Generally, this was accomplished as follows. The compositions of the anisotropic particles consist of, on an atomic percentage basis, about 40 to 90 percent of iron or mixtures of cobalt and iron, with the iron preferably making up at least 60 percent of the non-rare earth metal content; about 10 to 40 percent of rare earth metal that necessarily includes neodymium and/or praseodymium, with the neodymium and/or praseodymium preferably making up at least about 60 percent of the rare earth content; and at least 0.5 percent boron. Preferably, iron makes up at least about 40 atomic percent of the total composition and the neodymium and/or praseodymium make up at least about six atomic percent of the total composition. Also, preferably, the boron content is in the range of about 0.5 to about 10 atomic percent of the total composition, but the total boron content may suitably be higher than this depending on the intended application for the magnetic composition.

Specific compositions which have been useful in preparing hot-worked, anisotropic permanent magnets of this type, in corresponding weight percentages, are as follows and contain the magnetic phase consisting of $Fe_{14}Nd_2B$ (or the equivalent) tetragonal crystals; about 27 to 31.5 percent rare earth (wherein 95 percent of this constituent is neodymium and the remainder is essentially praseodymium); about 0.8 to about 1.0 percent boron; and the balance being iron with cobalt being substituted for the iron in some instances from about 2 to about 16 percent. In addition, gallium may also be added in an amount of between about 0.55 and 0.75 percent.

However, it is to be understood that the teachings of this invention are applicable to the larger family of compositions as described above in atomic percentages and will be referred to generally as an iron-neodymium-boron composition.

Alloy ingots of the preferred composition were melted by induction heating under a dry, substantially oxygen-free argon atmosphere to form a uniform molten composition. While under such an inert atmosphere and at a pressure of about 2 to 3 psig, the molten composition was ejected down through a ceramic nozzle onto the perimeter of a rotating wheel. The velocity of the wheel was sufficient so that when the melt struck the wheel, it solidified substantially instantaneously to form ribbon fragments which were thrown from the wheel. The fragments were collected and determined to be substantially amorphous.

This amorphous, melt-spun iron-neodymium-boron composition was then milled to a powder and then heated to a temperature of about 750° C. in a die and compacted between upper and lower punches to form a flat cylindrical plug one inch in diameter by about $\frac{5}{8}$ inch in thickness. The still hot, fully densified body was then transferred to a larger die at about 750° C. in which it was die upset to form a cylindrical plug about $1\frac{3}{8}$ inch in diameter by about $\frac{1}{4}$ inch in thickness.

This die upset body was an unmagnetized composition that had appreciable magnetic coercivity and was magnetically anisotropic. By die upsetting, the grains in the body are flatted and aligned with their major dimension lying transverse to the direction of pressing. The maximum dimensions of the grains were in the range of about 100 to 300 nanometers. The grains contained tetragonal crystals in which the proportions of iron, neodymium and boron were in accordance with the formula $Nd_2Fe_{14}B$.

The unmagnetized block was then pulverized at ambient temperature under an argon atmosphere or other inert atmosphere to form a fine powder to about 50 to 500 micrometers, preferably about 100 to 250 micrometers, in particle size. Each of the powder particles consisted of many plastically deformed and aligned grains of the $Nd_2Fe_{14}B$ phase. The grains within the powder were magnetically anisotropic and were still in the 100 to 300 nanometer size range.

In accordance with the teachings of this invention, the magnetic coercivity of these anisotropic particles was further enhanced by heat treating the individual particles of the powder. Preferably, the particles are heated to a temperature of about 550° C. to about 675° C., most preferably about 600° C., and for a duration sufficient to uniformly heat the particles, so as to increase the coercivity of the particles. As stated previously, the reason for this increase in coercivity is unclear but is possibly due to cumulative stress relief within the grains and a corresponding increase in the grain boundary surface area. The particular heat treatment parameters will be discussed more fully later in the specific examples.

In order to determine the magnetic properties of the heat-treated, anisotropic particles formed in accordance with this invention by conventional Vibrating Sample Magnetometer (VSM) tests, a small portion of the heat-treated, anisotropic particles were then mixed with an appropriate epoxy, preferably a two-part liquid epoxy of the type curable in about 12 to 24 hours at room temperature, to form a cubic sample. For example, 80 parts by weight of the heat-treated, anisotropic particles were mixed with 20 parts by weight of the epoxy, and the mixture was placed into a cylindrical cup-shaped metal container about ½ inch in diameter by about one inch long. The container was filled nearly completely with the powder-epoxy mixture, and a metal lid was placed on top of the mixture to substantially close the top of the container.

The container and its contents were then placed in a 20 kiloOersted magnetic field parallel to the longitudinal axis of the container for 30 seconds to magnetically align the iron-neodymium-boron particles in the container. The container was then placed in a 10 kiloOersted field parallel to the longitudinal axis of the container for 12 hours while the epoxy cured. Following this 12 hour period, the cured epoxy magnetic particle mixture was removed from the container and a small cube, having a dimension of about ¼ inch on each edge, was cut from the cylindrical specimen. The cube was cut so that two opposing faces were perpendicular to the direction of the magnetic field applied to align the particles therein, i.e., the axis of the cube perpendicular to such opposing faces was parallel to the applied magnetic field. Thus, the other two orthogonal axes of the cube were transverse to the direction of magnetic alignment of the particles in the cubic specimen.

The cube was then placed into the VSM and oriented such that its axis parallel to the direction of alignment was parallel to the direction of the field applied by the magnetometer. The sample was then magnetized to saturation and then demagnetized in the VSM. Results of the VSM tests indicate that the intrinsic coercivity of the anisotropic particles is significantly improved by the thermal treatment of the particles in accordance with this invention, as compared to conventional non-heat treated anisotropic particles. Specific examples of such are as follows.

EXAMPLE 1

Anisotropic particles were produced in accordance with the teachings of U.S. Pat. No. 4,842,656 by first melt spinning to form essentially amorphous ribbons, then hot pressing and hot working a body formed form the amorphous ribbons, and finally pulverizing the hot-worked body. The nominal compositions of the anisotropic particles was, in weight percent, about 30.5 percent rare earth, about 0.9 percent boron, about 2.5 percent cobalt and the balance iron. The rare earth constituent consisted essentially of neodymium and praseodymium; specifically of the 30.5 weight percent rare earth constituent within the anisotropic composition, about 29.7 percent was the neodymium and about 0.5 percent was the praseodymium.

The anisotropic particles were than heat treated at various temperatures in argon for a duration of about four minutes and then cooled to room temperature in the ventilated argon atmosphere. The duration of exposure may vary up to about 10 minutes, but it is preferable to minimize the duration so as not to promote unnecessary grain growth. The intrinsic coercivity (H) of the particles was determined using VSM techniques for both (1) non-heat treated anisotropic particles and (2) anisotropic particles heat treated at the various temperatures in accordance with this invention.

TABLE I

| Temperature (°C.) | Intrinsic Coercivity (kOe) |
|---|---|
| Unheated | 12.81 |
| 600 | 13.91 |
| 620 | 13.76 |
| 640 | 13.81 |
| 660 | 13.72 |

As shown above, the intrinisic coercivity of the non-heat treated anisotropic particles of this particular composition was determined to be about 12.81 kiloOersteds. The intrinisic coercivity of the anisotropic particles of the same composition increased to a level of about 13.91 kiloOersteds at about 600° C., with a gradual decrease in coercivity at temperatures greater than about 600° C.

EXAMPLE 2

Anisotropic particles were produced in accordance with the teachings of U.S. Pat. No. 4,842,656 having a nominal composition, in weight percent, of about 30.5 percent rare earth, about 0.9 percent boron, about 15.5 percent cobalt and the balance iron. The rare earth constituent consisted essentially of about 95 percent neodymium and the remainder praseodymium.

As in Example 1, the anisotropic particles were then heat treated at various temperatures in argon for a duration of about four minutes and then cooled to room temperature in the ventilated argon atmosphere. The intrinisic coercivity (H) of the particles was determined using VSM techniques for both (1) the non-heat treated anisotropic particles and (2) the anisotropic particles heat treated in accordance with this invention at various temperatures.

TABLE II

| Temperature (°C.) | Intrinsic Coercivity (kOe) |
|---|---|
| Unheated | 10.92 |
| 400 | 10.46 |
| 450 | 10.54 |
| 580 | 11.67 |
| 600 | 11.76 |
| 660 | 11.10 |
| 680 | 10.46 |

As shown above, the intrinsic coercivity of the non-heat treated anisotropic particles of this particular composition was determined to be about 10.92 kiloOersteds. The presence of cobalt within the magnetic composition causes a decrease in the inherent coercivity as compared to the magnetic composition of Example 1 but is a desirable addition to the composition because it enhancers the corrosion resistance of the composition.

The intrinsic coercivity of the anisotropic particles of this composition, which were heat treated in accordance with this invention, reached a maximum value at about 600° C. of about 11.76 kiloOersteds with a gradual decrease at temperatures above this temperature. The heat treatments at about 400° C. and 450° C. resulted in a loss in coercivity for the anisotropic particles, as compared to the non-heat treated anisotropic particles. The preferred range of heating temperatures appears to be about 550° C. to about 675° C.

EXAMPLE 3

Anisotropic bonded magnets of the $RE_2TM_{14}B$ composition given in Example 1 were formed using anisotropic powders which had been heat treated in accordance with this invention and with anisotropic powders which had not been heat treated. The heat treatment consisted of heating the powders to a temperature of about 600° C. in an argon atmosphere for a duration of about four minutes and then cooling in the argon atmosphere to room temperature. The bonded magnets, both heat treated and not heat treated, were aged at about 80° C. for a duration of about 1,000 hours. The loss in magnetic properties of the magnets was determined after aging.

The anisotropic bonded magnets formed from the anisotropic particles which were heat treated after pulverization, in accordance with this invention, exhibited a total loss in magnetic properties of about 6.5 percent. Irreversible magnetic loss was about 5.1 percent with the remaining 1.4 percent loss due to structural losses. (Structural losses are defined as those losses which can not be recovered by remagnetization). The anisotropic bonded magnets formed from the anisotropic particles which were not heat treated after pulverization exhibited a total loss in magnetic properties of about 8.6 percent. The irreversible magnetic loss of about 5.3 percent in the non-heat treated particles was comparable to the heat treated particles. However, the structural loss of the non-heat treated particles was significantly higher at about 3.3 percent.

In summary, the coercivity of magnetically anisotropic powders is enhanced by appropriately heating the powders prior to forming a magnetic body from them. The coercivity is typically in excess of 10,000 Oersteds when enhanced by the teachings of this invention, but certainly in excess of about 5,000 Oersteds. The magnetically anisotropic powder is initially produced by providing very rapidly solidified, such as by melt spinning, metal particles that are amorphous or of extremely fine grain size. The particles are then either hot pressed and/or hot worked to produce plastically deformed and aligned grains in the consolidated mass that are in the size range of about 20 to about 500 nanometers. The consolidation and hot deformation of the particles may be carried out by any of several suitable processes such as hot pressing, hot isostatic pressing, hot die upsetting, forging, extrusion, rolling and the like. Since the grains are deformed so that they are aligned with their major dimensions in the direction of the flow of the deformed material (usually perpendicular to the force applied for hot working), the body is magnetically anisotropic and coercive. When the body is pulverized, the resultant powder retains its magnetic coercivity and is also magnetically anisotropic. By heating the pulverized anisotropic particles to a sufficient temperature in accordance with this invention, the magnetic coercivity of these particles is further enhanced.

The preferred compositions necessarily contain iron, neodymium and/or praseodymium, and boron in the preferred amounts specified above. The composition may also contain other constituents, providing that the anisotropic particles necessarily contain the magnetic phase $RE_2TM_{14}B$ along with at least one additional phase at the grain boundaries that is richer in rare earth. In the essential magnetic phase, TM is preferably at least 60 percent iron and RE is preferably at least 60 percent neodymium and/or praseodymium.

A particularly advantageous feature of this invention is that the magnetic coercivity of the anisotropic particles is enhanced by heat treating of the particles without a loss in the other magnetic properties of the particle, particularly the magnetic remanence. These particles may be magnetically aligned and bonded together to form a magnetic body that has a preferred direction of magnetization which may then be useful in a variety of applications which require a permanent magnet having strong anisotropic properties.

Therefore, while my invention have been described in terms of a preferred embodiment, it is apparent that other forms could be adopted by one skilled in the art, such as by modifying the composition of the magnetic particles within the preferred ranges, or by substituting different processing steps employed, or by enhancing the coercivity of magnetic alloys which may even include isotropic compositions. Accordingly, the scope of my invention is to be limited only by the following claims.

The embodiments of the invention in which an exclusive property or privilege is claimed are defined as follows:

1. A method for forming magnetically anisotropic particles of a composition that has as its magnetic constituent the tetragonal crystal phase $RE_2TM_{14}B$, wherein the particles have an intrinsic coercivity at room temperature of at least about 5,000 Oersteds, comprising the steps of:

providing a hot-worked body comprising plastically deformed, platelet-shaped grains of said phase wherein said grains are aligned and have an average largest dimension no greater than about 500 nanometers, the composition of said body comprising, on an atomic percent basis, about 40 to 90 percent transition metal (TM) taken from the group consisting of iron and mixtures of iron and cobalt wherein iron makes up at least 40 percent of the total composition, about 10 to 40 percent rare earth metal (RE) wherein at least about 6 percent of the total composition is neodymium and/or praseodymium, and at least about 0.5 percent boron; and comminuting said body to form a powder, the individual particles of said powder each comprise a multitude of said aligned grains, said particles thereby being magnetically anisotropic and having a first intrinsic magnetic coercivity, wherein the improvement comprises the further step of:

heating the individual particles of said powder at a temperature and for a duration sufficient to effect a second intrinsic magnetic coercivity within said particles which is greater than said first magnetic coercivity.

2. A method for forming magnetically anisotropic particles as recited in claim 1 wherein said heating step occurs at a temperature of about 550° C. to about 675° C.

3. A method for forming magnetically anisotropic particles of a composition that has as its magnetic constituent the tetragonal crystal phase $RE_2TM_{14}B$, wherein the particles have an intrinsic coercivity at room temperature of at least 5,000 Oersteds, comprising the steps of:

rapidly solidifying a melt of a composition comprising, on an atomic percent basis, about 40 to 90 percent transition metal (TM) taken from the group consisting of iron and mixtures of iron and cobalt wherein iron makes up at least 40 percent of the total composition, about 10 to 40 percent rare earth metal (RE) wherein at least about 6 percent of the total composition is neodymium and/or praseodymium, and at least about 0.5 percent boron, and forming a particulate solid material thereof in which crystalline material, if present, has a grain size no larger than about 500 nanometers;

hot pressing said particles into a body and thereafter hot working said body to plastically deform the original particulate constituents so as to thereby produce in said body aligned platelet-shaped grains of said magnetic phase wherein the largest average dimension is no greater than about 500 nanometers; and comminuting said body to form a powder, the individual particles of said powder each comprise a multitude of said aligned grains, said particles thereby being magnetically anisotropic and having a first intrinsic magnetic coercivity, wherein the improvement comprises the further step of:

heating the individual particles of said powder at a temperature and for a duration sufficient to effect a second intrinsic magnetic coercivity within said particles which is greater than about 5,000 Oersteds and greater than said first magnetic coercivity.

4. A method for forming magnetically anisotropic particles as recited in claim 3 wherein said heating step occurs at a temperature of about 550° C. to about 675° C.

* * * * *